US005477562A

United States Patent [19]

Dixon

[11] Patent Number: 5,477,562

[45] Date of Patent: Dec. 26, 1995

[54] APPARATUS FOR THE RETAINING OF THE CONTENTS IN POCKETS OF GARMENTS

[76] Inventor: Corbin Dixon, Rte. 3, Box 158-P, Staunton, Va. 24401

[21] Appl. No.: 332,848

[22] Filed: Nov. 1, 1994

[51] Int. Cl.[6] ..... A41D 27/20

[52] U.S. Cl. ..... 2/250; 2/247; 2/252; 2/115; 24/3.5

[58] Field of Search ..... 2/247, 248, 249, 2/250, 251, 252, 115, 113, 75, 69, 253, 254, 255, 256, 259, 260; 24/3.5

[56] References Cited

U.S. PATENT DOCUMENTS

| | | | |
|---|---|---|---|
| 136,983 | 3/1873 | Engel | 24/3.5 |
| 438,674 | 10/1890 | Bastian | 24/3.5 |
| 1,621,826 | 3/1927 | Burtchaell | 2/250 |
| 2,530,608 | 11/1950 | Fraser | 2/250 |
| 4,716,600 | 1/1988 | Van Beek | 2/250 |
| 4,972,524 | 11/1990 | Gasser | 2/250 |
| 5,365,614 | 11/1994 | Perkins | 2/250 |

*Primary Examiner*—Jeanette E. Chapman

[57] ABSTRACT

An apparatus for the retaining of the contents in pockets of garments comprising a garment having a pocket, the pocket formed with side edges and a bottom edge stitched to the garment over one chest area, the garment pocket having a free open upper edge for the insertion and removal of objects to and from the area between the pocket and garment; and a resilient component in a curved configuration removably positioned in the operative association with the upper edge of the pocket.

3 Claims, 4 Drawing Sheets

APPARATUS FOR THE RETAINING OF THE CONTENTS IN POCKETS OF GARMENTS

BACKGROUND OF THE INVENTION

1. Field of the Invention

The present invention relates to an apparatus for the retaining of the contents in pockets of garments and more particularly pertains to insuring that the contents of a garment pocket are retained therein when moving or bending.

2. Description of the Prior Art

The use of devices to retain items in pockets or other containers of a wide variety of designs and configurations is known in the prior art. More specifically, devices to retain items in pockets or other containers of a wide variety of designs and configurations heretofore devised and utilized for the purpose of retaining the contents in pockets are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,477,068 a pocket guard.

U.S. Pat. No. 3,782,614 discloses a binocular pocket.

U.S. Pat. No. 4,062,064 discloses an eyeglass pocket shirt.

U.S. Pat. No. 4,156,295 discloses a revised pocket.

U.S. Pat. No. 4,903,375 discloses a pocket clip for eyeglasses.

In this respect, the apparatus for the retaining of the contents in pockets of garments according to the present invention substantially departs from the conventional concepts and designs of the prior art, and in doing so provides an apparatus primarily developed for the purpose of insuring that the contents of a garment pocket are retained therein when moving or bending.

Therefore, it can be appreciated that there exists a continuing need for a new and improved apparatus for the retaining of the contents in pockets of garments which can be used to insure that the contents of a garment pocket are retained therein when moving or bending. In this regard, the present invention substantially fulfills this need.

SUMMARY OF THE INVENTION

In view of the foregoing disadvantages inherent in the known types of devices to retain contents in pockets or other containers of a wide variety of designs and configurations now present in the prior art, the present invention provides an improved apparatus for the retaining of the contents in pockets of garments. As such, the general purpose of the present invention, which will be described subsequently in greater detail, is to provide a new and improved apparatus for the retaining of the contents in pockets of garments and method which has all the advantages of the prior art and none of the disadvantages.

To attain this, the present invention essentially comprises a new and improved apparatus for the retaining of the contents in pockets of garments comprising, in combination, a garment having a pocket, the pocket formed with side edges and a bottom edge stitched to the garment over one chest area, the garment pocket having a free open upper edge for the insertion and removal of objects to and from the area between the pocket and garment; a hollow hem formed by additional material bent downwardly from the upper edge of the pocket and inwardly terminating at a free edge with stitching securing the free edge to an intermediate portion of the pocket at a location beneath the upper edge of the pocket and parallel therewith, the lateral ends of the hem being unsecured and open to form a horizontal passageway therethrough; a resilient component having a front face, a rear face, upper and lower long edges spaced to a height slightly less than the height of the passageway and with short parallel vertical edges spaced a distance slightly less than the lateral width of the passageway; and a plurality of bends extending vertically in the resilient member whereby the majority of the central extent of the resilient component as well as the opposed ends thereof are closer to the garment than the remaining portions whereby a resilient force from the component in the hem urges the majority of the extent of the pocket toward the fabric of the garment at the upper edge of the pocket.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for the retaining of the contents in pockets of garments which has all the advantages of the prior art devices to retain objects in pockets or other containers of a wide variety of designs and configurations and none of the disadvantages.

It is another object of the present invention to provide a new and improved apparatus for the retaining of the contents in pockets of garments which may be easily and efficiently manufactured and marketed.

It is further object of the present invention to provide a new and improved apparatus for the retaining of the contents in pockets of garments which is of durable and reliable constructions.

An even further object of the present invention is to provide a new and improved apparatus for the retaining of the contents in pockets of garments which is susceptible of a low cost of manufacture with regard to both materials and labor, and which accordingly is then susceptible of low prices of sale to the consuming public, thereby making such apparatus for the retaining of the contents in pockets of garments economically available to the buying public.

Still yet another object of the present invention is to provide a new and improved apparatus for the retaining of the contents in pockets of garments which provides in the apparatuses and methods of the prior art some of the advantages thereof, while simultaneously overcoming some of the disadvantages normally associated therewith.

Still another object of the present invention is to insure that the contents of a garment pocket are retained therein when moving or bending.

Lastly, it is an object of the present invention to provide a new and improved apparatus for the retaining of the contents in pockets of garments comprising a garment having a pocket, the pocket formed with side edges and a bottom edge stitched to the garment over one chest area, the garment pocket having a free open upper edge for the insertion and removal of objects to and from the area between the pocket and garment; and a resilient component in a curved configuration removably positioned in the operative association with the upper edge of the pocket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
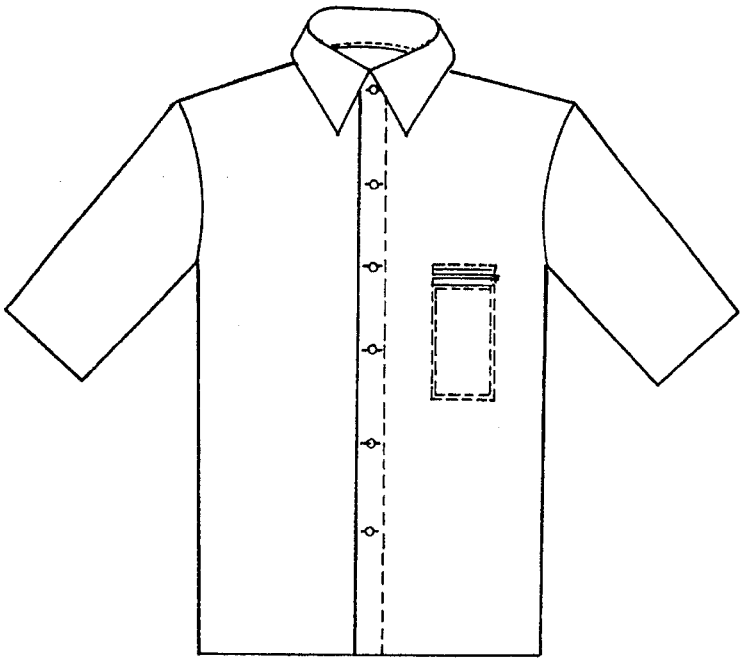
FIG 1 PRIOR ART
FIG. 1 is a front elevational view of a prior art structure for retaining pockets in contents.
Figure 2:
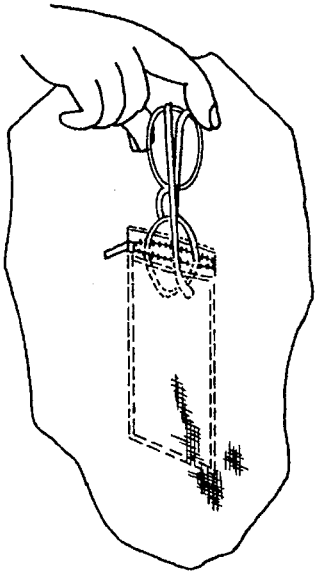
FIG 2 PRIOR ART
FIG. 2 is an enlarged perspective view of a prior art construction for retaining objects within a pocket.
Figure 3:
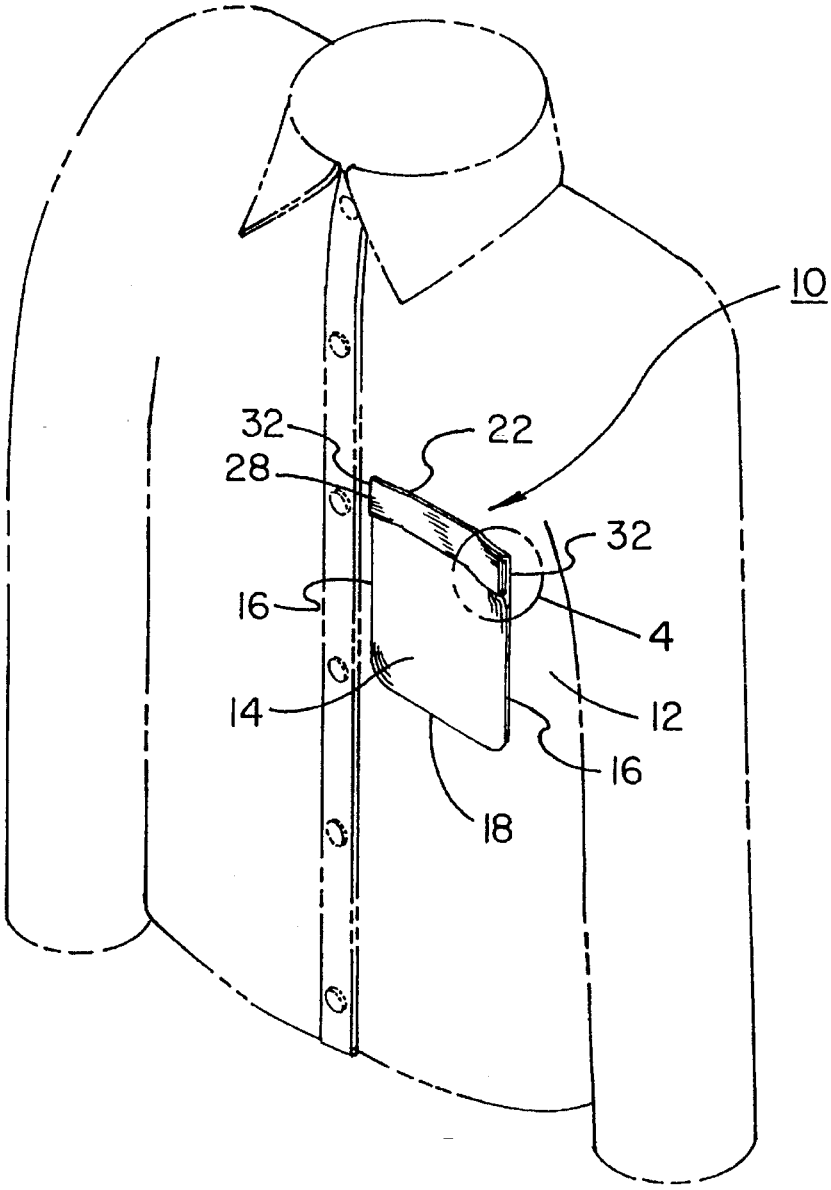
FIG. 3 is perspective view of the preferred embodiment of the new and improved apparatus for the retaining of the contents in pockets of garments constructed in accordance with the principles of the present invention.
Figure 4:
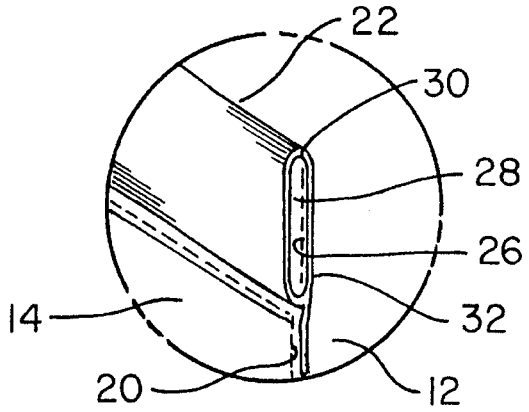
FIG. 4 is an enlarged perspective view of the end of the pocket closure apparatus taken along circle 4 of FIG. 3.
Figure 5:
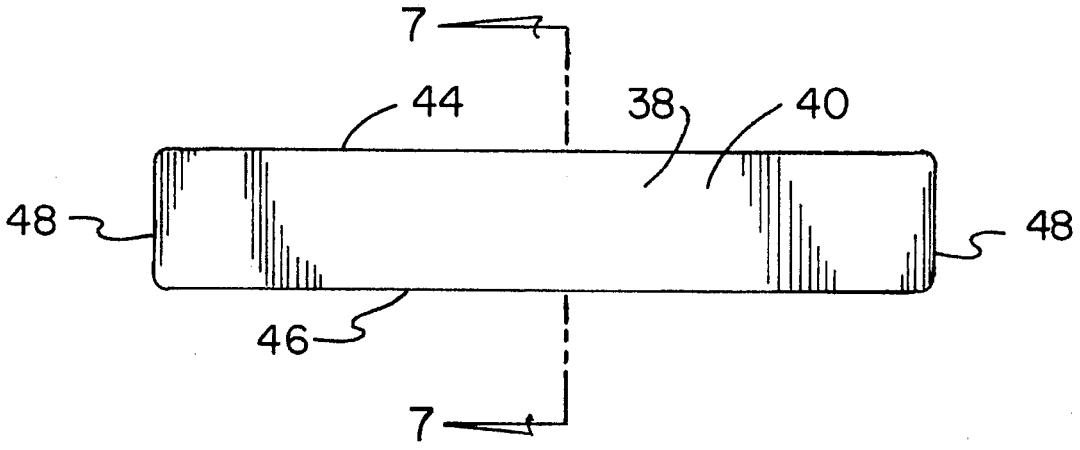
FIG. 5 is a front elevational view of the insert component adapted to be used in association with the apparel shown in FIGS. 3 and 4.
Figure 6:
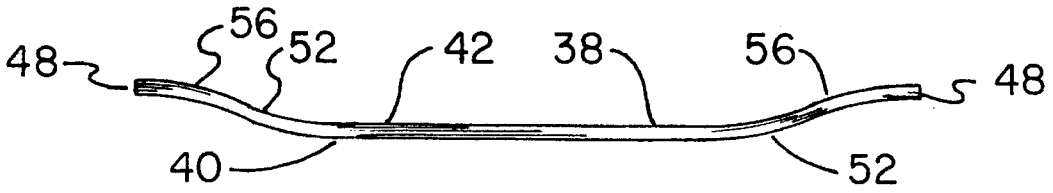
FIG. 6 is a top elevational view of the insert device shown in FIG. 5.
Figure 7:
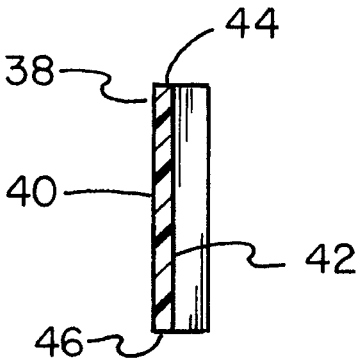
FIG. 7 is a cross-sectional view taken along line 7—7 of FIG. 5.

With reference now to the drawings, and in particular to FIG. 3 thereof, the preferred embodiment of the new and improved apparatus for the retaining of the contents in pockets of garments embodying the principles and concepts of the present invention and generally designated by the reference numeral 10 will be described.

The present invention, the new and improved apparatus for the retaining of the contents in pockets of garments, is a system comprised of a plurality of components. Such components, in their broadest context, consist of a garment with a pocket, a hollow hem, a resilient component and bends in the resilient component. Such components are individually configured and correlated with respect to each other so as to attain the desired objective.

The system 10 of the present invention has for its central components a garment 12 and a pocket 14. The pocket is formed with side edges 16 and a bottom edge 18 which are coupled to the garment by stitches 20. The pocket is preferably located on the garment over one chest area. The garment pocket has a free open upper edge 22 for the insertion and removal of objects to and from the area between the pocket and the garment.

Next provided is a hollow hem 26. The hem is formed by additional material 28 formed with a bend 30 to extend downwardly from the upper edge of the pocket and then inwardly where it terminates at a free edge. Stitching secures the free edge to an intermediate portion of the pocket at a location beneath the upper edge of the pocket. Such stitching is parallel with the upper edge spaced therebeneath. The lateral ends 32 of the hem are unsecured and open. There is thus formed a horizontal passageway 34 therethrough.

The next component of the system 10 of the present invention is a resilient component 38. The resilient component has a front face 40, a rear face 42 along with upper and lower edges 44 and 46. The upper and lower edges are spaced to a height slightly less than the height of the passageway to allow movement therethrough. Coupling the upper and lower edges are short parallel vertical edges 48. The short edges are spaced from each other a distance less than the lateral width of the passageway.

Lastly, formed in the resilient component are a plurality of bends 52 and 56. The bends all extend vertically in the resilient member. The bends are such that the majority of the central extent of the resilient component, and insert, as well as the opposed ends thereof are closer to the garment than the remaining portion of the resilient component. In this manner, a resilient force is generated from the resilient component in the hem. Such force urges the majority of the central extent of the pocket toward the fabric of the garment at the upper edge of the pocket. This in effect generates an automatic closure of the opening at the upper edge of the pocket so that items therein will not fall out when the person wearing the garment bends over or engages in strenuous activity.

Figure 8:
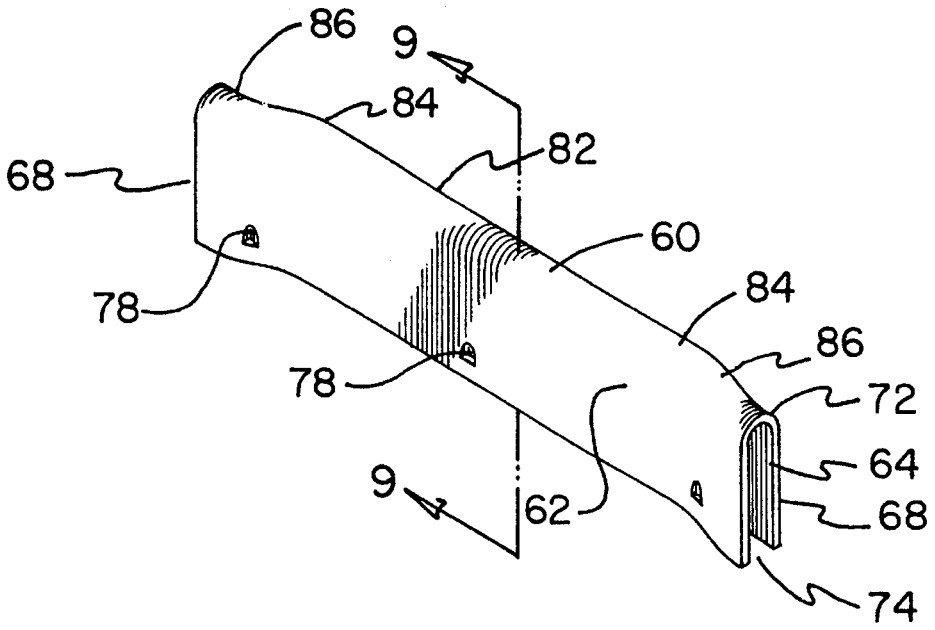
FIG. 8 is a perspective illustration of an alternate embodiment of the invention.
Figure 9:
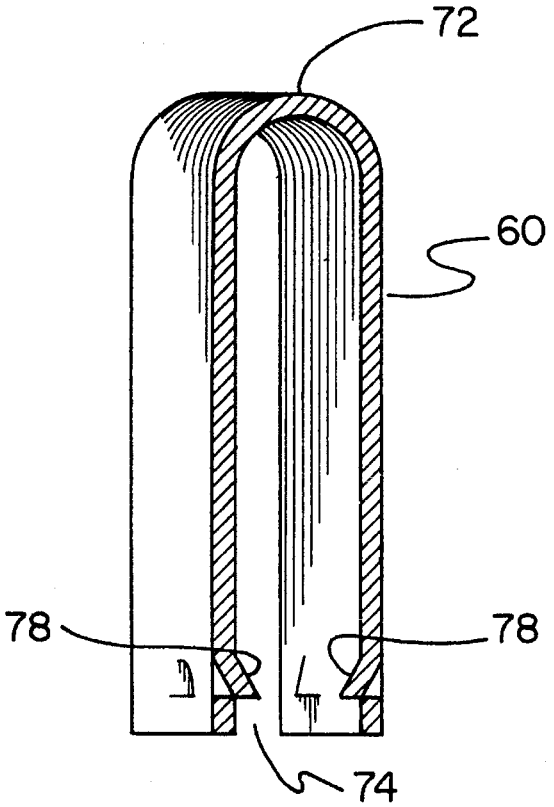
FIG. 9 is a cross-sectional view taken along line 9 of FIG. 8.

An alternate embodiment of the invention is shown in FIGS. 8 and 9. In such alternate embodiment, the resilient component 60 is formed in an inverted U-shaped configuration. This is to allow utilization of the device without altering the construction of the fabric of the pocket of the garment on which the device is to be utilized. The device has a rear face 62 and a front face 64 essentially parallel with respect to each other throughout their extents. The device has short parallel end edges 68 extending vertically and generally parallel with respect to each other. The front and rear surfaces are coupled together at the upper edge 72 of the device where the device takes a semi-circular bend to generate the essentially inverted U-shaped configuration. Opposite the upper edge 72 is a lower open edge 74 for receiving the upper edge of the pocket for operation and use.

The device has, at spaced locations, a plurality of cutout portions forming projections 78 in the lower regions of the front and rear faces. Such is for penetrating the fabric of the pocket to insure retention thereof during operation and use. As in the primary embodiment, the device has a long generally linear extent 82 between the end edges 68. At the ends of the linear extent 82 are bends 84 as in the first embodiment. In addition, linear end sections 86 are located between the bends 84 and the ends 68. As in the prior embodiment, this configuration allows the majority of the pocket to be extended outwardly away from the garment for the proper receipt of articles such as pencils and pens to be received in the pocket and maintained in position through the apparatus of the present invention.

There is a problem very common to most people who routinely keep objects in the pocket of a shirt or similar garment. The problem is that the objects kept in that pocket have a tendency to fall out when the wearer bends over. Eyeglasses are a perfect example of this even when they are in a protective case that supposedly attaches to your pocket. The case still has a tendency to slide out. This is annoying, to say the least. What is needed is some simple, inexpensive, and unobtrusive way of restraining the objects in one's pocket and that is what the present invention provides.

The present invention consists of a metal or plastic spring or clip that attaches to the top inside edge of the pocket. It is secured by means of a slot across the width of the pocket edge. The tension of the clip keeps the mouth of the pocket tight against any objects being carried there by the user. The clip could be a permanent part of the garment or something that is added on after the garment manufacturing process.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved apparatus for the retaining of the contents in pockets of garments comprising, in combination:

a garment having a pocket, the pocket formed with side edges and a bottom edge stitched to the garment over one side of a chest area, the garment pocket having a free open upper edge for the insertion and removal of objects to and from an area between the pocket and garment;

a hollow hem formed by additional material bent downwardly from the upper edge of the pocket and inwardly terminating at a free edge with stitching securing the free edge to an intermediate portion of the pocket at a location beneath the upper edge of the pocket and parallel therewith, a pair of lateral ends of the hem being unsecured and open to form a horizontal passage way therethrough, the horizontal passage way having a height and a lateral width;

a resilient component having a front face, a rear face, upper and lower long edges spaced to a height slightly less than the height of the passageway and with short parallel vertical edges spaced a distance slightly less than the lateral width of the passageway; and the resilient component being formed to have a plurality of bends extending vertically in the resilient component whereby the majority of a central extent of the resilient component as well as opposed ends thereof are closer to the garment than each vertical edge whereby a resilient force from the component in the hem urges the majority of the extent of the pocket toward the fabric of the garment at the upper edge of the pocket.

2. The apparatus as set forth in claim 1 wherein the resilient component is formed in an inverted U-shaped configuration with a plurality of cut-out portions forming projections for fabric penetration and positionable over the upper edge of the pocket.

3. A new and improved apparatus for the retaining of the contents in pockets of garments comprising, in combination:

a garment having a pocket, the pocket formed with side edges and a bottom edge stitched to the garment over one side of a chest area, the garment pocket having a free open upper edge for the insertion and removal of objects to and from an area between the pocket and garment;

a hollow hem formed by additional material bent downwardly from the upper edge of the pocket and inwardly terminating at a free edge with stitching securing the free edge to an intermediate portion of the pocket at a location beneath the upper edge of the pocket and parallel therewith, a pair of lateral ends of the hem being unsecured and open to form a horizontal passage way therethrough, the horizontal passage way having a height and a lateral width;

a resilient component in an inverted U-shaped configuration having a front face, a rear face, upper and lower long edges spaced to a height slightly less than the height of the passageway and with short parallel vertical edges spaced a distance slightly less than the lateral width of the passageway, the front face and rear face are coupled together at the upper edge to form a semi-circular bend; and the resilient component being formed to have a plurality of bends extending vertically in the resilient component on the front and rear face, the bends on each face being parallel whereby the majority of a central extent of the rear face of the resilient component as well as opposed ends thereof are closer to the garment than each vertical edge whereby a resilient force from the component in the hem urges the majority of the extent of the pocket toward the fabric of the garment at the upper edge of the pocket.

* * * * *